US009291160B2

(12) United States Patent
Quam

(10) Patent No.: US 9,291,160 B2
(45) Date of Patent: Mar. 22, 2016

(54) ELEVATOR CONTROL FOR INDUCTOR PUMP

(71) Applicant: Graco Minnesota Inc., Minneapolis, MN (US)

(72) Inventor: Paul R. Quam, Minneapolis, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 22 days.

(21) Appl. No.: 14/510,787

(22) Filed: Oct. 9, 2014

(65) Prior Publication Data

US 2015/0023806 A1 Jan. 22, 2015

Related U.S. Application Data

(63) Continuation of application No. 12/930,637, filed on Jan. 12, 2011, now Pat. No. 8,887,966.

(60) Provisional application No. 61/294,327, filed on Jan. 12, 2010.

(51) Int. Cl.

| | |
|---|---|
| ***B67B 7/00*** | (2006.01) |
| ***F04B 49/02*** | (2006.01) |
| ***F04B 9/123*** | (2006.01) |
| ***F04B 17/06*** | (2006.01) |

(52) U.S. Cl.

CPC ..... *F04B 49/02* (2013.01); *F04B 9/123* (2013.01); *F04B 17/06* (2013.01); *Y10T 137/0318* (2015.04); *Y10T 137/85978* (2015.04); *Y10T 137/87056* (2015.04)

(58) Field of Classification Search

CPC ..... F04B 9/123; F04B 17/06; F04B 49/02; Y10T 137/0318; Y10T 137/85976; Y10T 137/87056

USPC ..... 222/1, 258, 261–263, 506, 340, 309, 222/249, 250, 253, 405, 334, 335, 397, 222/386–389; 137/636.1, 565.01; 417/118, 417/120, 53

See application file for complete search history.

(56) References Cited

U.S. PATENT DOCUMENTS

| | | | |
|---|---|---|---|
| 2,221,763 | A | 11/1940 | Ginter |
| 2,280,708 | A | 4/1942 | Klein et al. |
| 2,394,486 | A | 2/1946 | Rotter et al. |
| 2,630,248 | A | 3/1953 | Hinz |

(Continued)

OTHER PUBLICATIONS

Graco Product Brochure, "Check-Mate ram package selection guide", pp. 1-20, printed 2010.

(Continued)

*Primary Examiner* — Lien Ngo

(74) *Attorney, Agent, or Firm* — Kinney & Lange, P.A.

(57) ABSTRACT

An inductor pump system comprises a fluid activated ram, an inductor pump platen, a fluid activated motor and a fluid control. The inductor pump platen is driven by the fluid activated ram. The fluid activated motor is coupled to the platen. The fluid control comprises an inlet for receiving a source of pressurized fluid, a first circuit and a second circuit. The first and second circuits are configured to receive pressurized fluid from the inlet. The first circuit comprises a switching valve connected to the inlet; an actuator line connected to the ram and the switching valve; and a blow-off line connected to the inductor pump platen and the switching valve. The second circuit is connected to the inlet to receive pressurized fluid and to the motor.

4 Claims, 10 Drawing Sheets

(56) References Cited

U.S. PATENT DOCUMENTS

| | | | | | |
|---|---|---|---|---|---|
| 2,925,941 | A | | 2/1960 | Bloxom | |
| 3,113,705 | A | | 12/1963 | Weitzel | |
| 3,430,812 | A | | 3/1969 | Leo et al. | |
| 3,601,285 | A | | 8/1971 | Leger et al. | |
| 3,976,229 | A | | 8/1976 | Jackson | |
| 3,982,669 | A | | 9/1976 | Moore | |
| 4,073,409 | A | * | 2/1978 | Gardner | F04B 23/023 222/146.5 |
| 4,389,001 | A | * | 6/1983 | Franklin | B29B 13/022 222/261 |
| 4,632,281 | A | | 12/1986 | Wold | |
| 5,081,902 | A | | 1/1992 | Rausch | |
| 5,117,998 | A | | 6/1992 | Handzel | |
| 5,248,069 | A | | 9/1993 | Consaga et al. | |
| 5,312,028 | A | | 5/1994 | Hume | |
| 5,762,468 | A | | 6/1998 | Blotenberg | |
| 6,003,732 | A | * | 12/1999 | Farley | B67D 7/0227 222/146.5 |
| 6,068,160 | A | | 5/2000 | Fancher | |
| 6,386,398 | B2 | | 5/2002 | Drake, Jr. | |
| 6,391,378 | B1 | | 5/2002 | Carr et al. | |
| 6,457,356 | B1 | | 10/2002 | Meloche | |
| 6,755,427 | B1 | | 6/2004 | Bray | |
| 8,251,603 | B2 | | 8/2012 | Kott et al. | |
| 8,544,699 | B2 | * | 10/2013 | Quam | F04F 1/06 222/261 |
| 2004/0088972 | A1 | | 5/2004 | Harnischfeger et al. | |
| 2008/0199322 | A1 | * | 8/2008 | Yamane | F01C 21/007 417/53 |
| 2011/0311374 | A1 | | 12/2011 | Ocalan et al. | |

OTHER PUBLICATIONS

Graco Product Brochure, "Graco Supply Systems, Sealant & Adhesive Supply Systems with NXT™ Technology", pp. 1-12, © 2006, 2007.

* cited by examiner

ELEVATOR CONTROL FOR INDUCTOR PUMP

CROSS-REFERENCE TO RELATED APPLICATION(S)

This application claims priority under 35 U.S.C. §120 to U.S. provisional application Ser. No. 61/294,327, entitled "ELEVATOR AIR CONTROLS," filed Jan. 12, 2010 and application Ser. No. 12/930,637, entitled "ELEVATOR CONTROL FOR INDUCTOR PUMP", filed Jan. 12, 2011 by inventor Paul R. Quam, the contents of which are incorporated by this reference.

BACKGROUND

The present invention relates generally to inductor pumps for pumping highly viscous fluid from containers. In particular, the present invention relates to elevator controls for lifting and lowering platens used to push the fluid from a drum or container.

Inductor pumps typically comprise a linear pneumatic ram that forces a pipe having a platen into a drum. The platen includes a central bore that leads to a passageway in the pipe. As the platen is lowered into the drum by the pneumatic ram, the highly viscous fluid is forced into the central bore and up the passageway. The fluid is pushed into a pneumatic pump that forces pressurized fluid through a hose into a dispensing device where an operator can dispense a metered amount of fluid into some other typically smaller container.

Compressed air for operating the pneumatic ram and the pneumatic pump is delivered to a control panel on the inductor pump from a compressor or some other source. A compressed air line from the control panel is connected to either the pneumatic ram or the pneumatic pump, depending on which sub-system is being operated. In order to lift the platen, the compressed air is connected to the pneumatic ram. An on/off valve on the control panel is opened to allow air into the actuator to lift the platen so that a container of fluid can be positioned under the platen. Sometimes it is necessary to manually open a vent in the platen to prevent a vacuum from forming in the container. The on/off valve is closed to allow the platen to descend into the container. With the platen in a container, the compressed air line is disconnected from the pneumatic actuator and connected to the pneumatic pump. The on/off valve then toggles operation of the pump to control dispensing of the fluid from the container. Quick disconnect couplings are used on the compressed air line to facilitate operation of the actuator and pump. However, operation of the inductor pump is slowed by having to wait for the container to fill through the vent and by having to switch the source of compressed air. There is, therefore, a need for a more expediently controlled inductor pump.

SUMMARY

The present invention is directed to inductor pump systems and fluid circuits for controlling inductor pump systems. In one embodiment, an inductor pump system comprises a fluid activated ram, an inductor pump platen, a fluid activated motor and a fluid control. The inductor pump platen is driven by the fluid activated ram. The fluid activated motor is coupled to the platen. The fluid control comprises an inlet for receiving a source of pressurized fluid, a first circuit and a second circuit. The first and second circuits are configured to receive pressurized fluid from the inlet. The first circuit comprises a switching valve connected to the inlet; an actuator line connected to the ram and the switching valve; and a blow-off line connected to the inductor pump platen and the switching valve. The second circuit is connected to the inlet and to the motor.

The present invention is also directed to methods of operating an inductor pump system. In one embodiment, the method comprises providing a source of pressurized fluid to a control module, opening a relieving valve to allow pressurized fluid to flow through a switching valve to an actuator to raise a platen out of a container, actuating the switching valve to direct fluid away from the actuator and to the container through the platen to pressurize the container, and toggling the switching valve to alternately route air from the switching valve to the container or to the actuator.

DETAILED DESCRIPTION

Figure 1A:
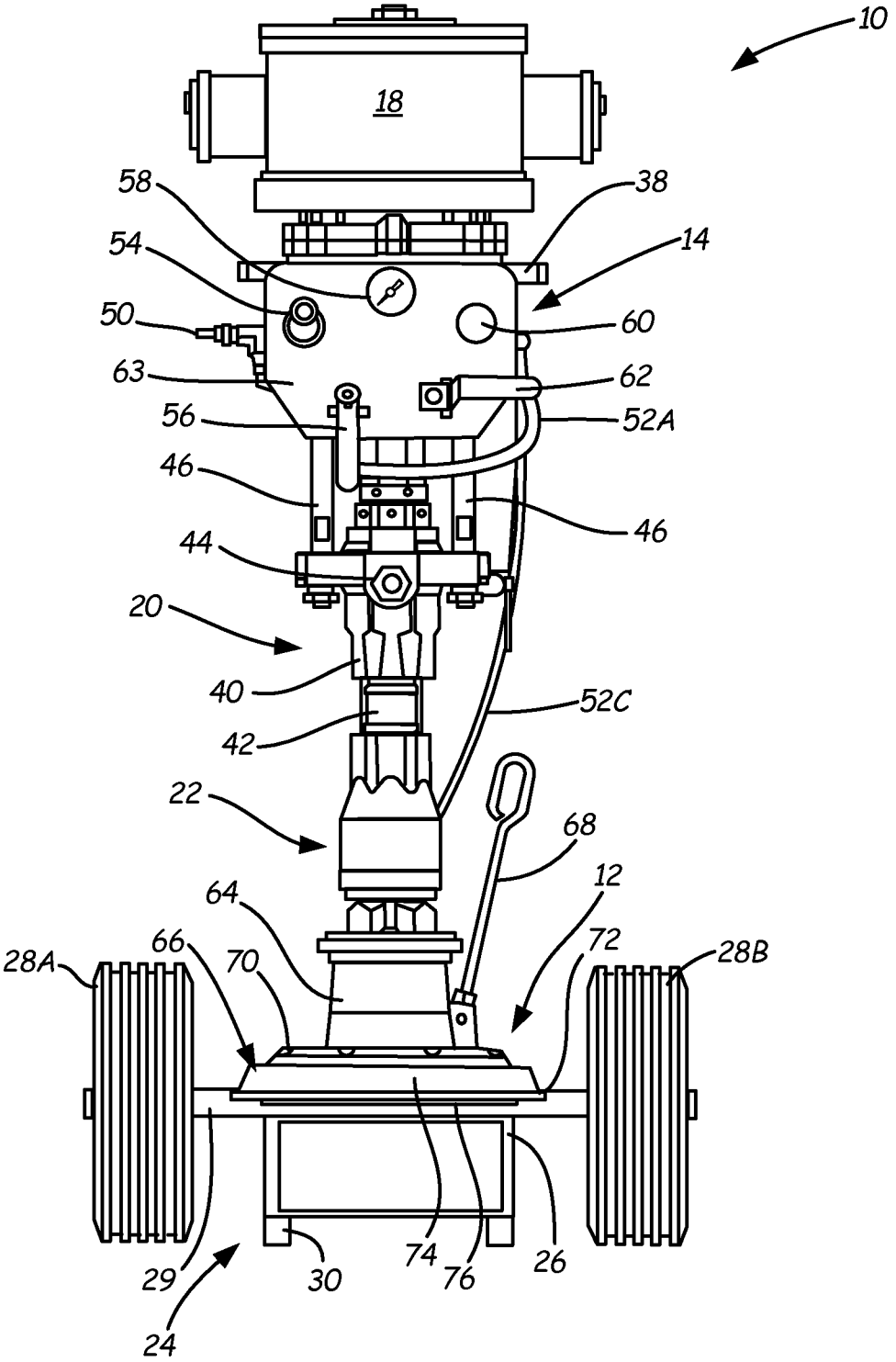
FIG. 1A is a front view of an inductor pump system having elevator air controls of the present invention for controlling position of a platen assembly above a platform.
Figure 1B:
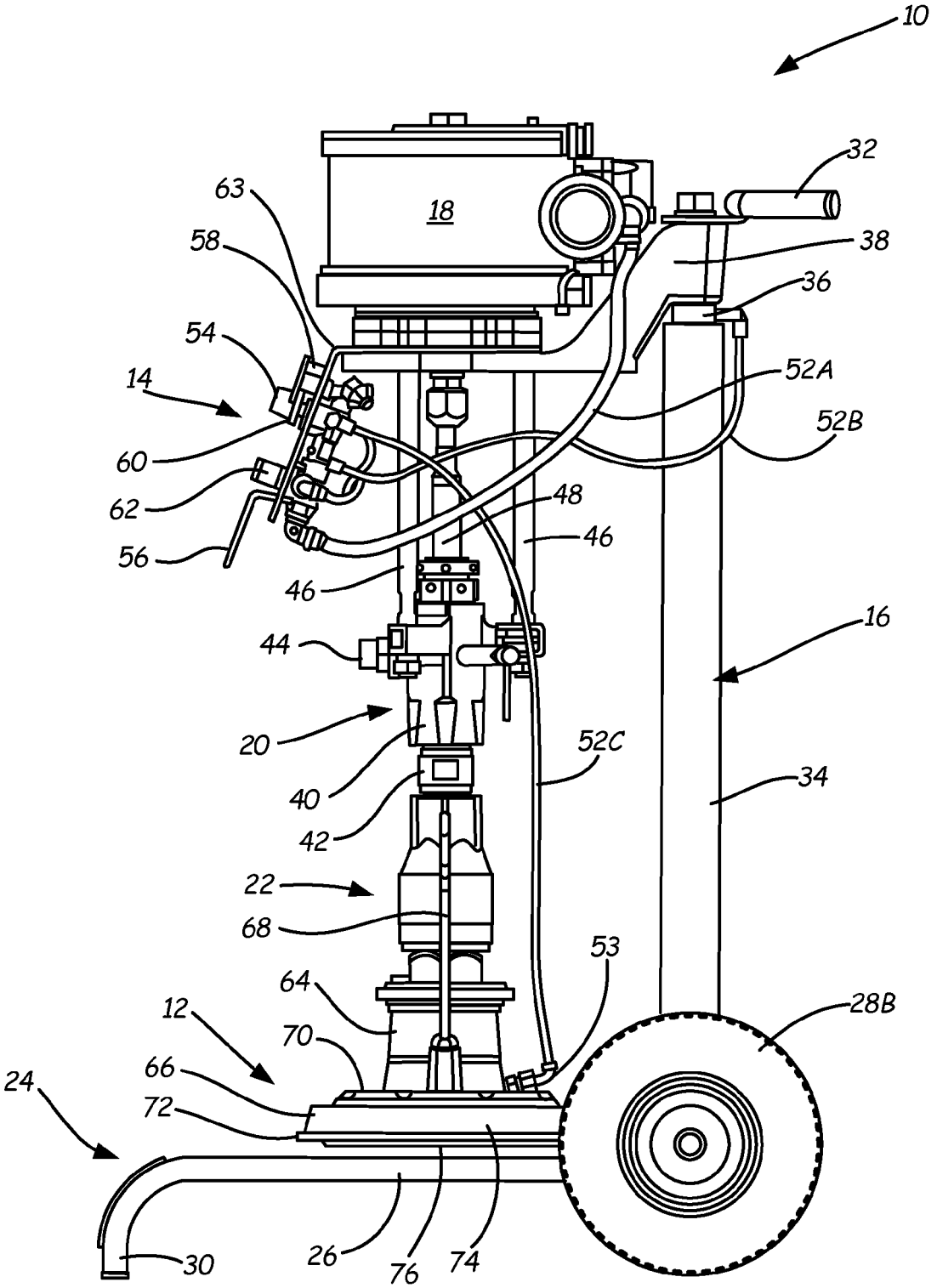
FIG. 1B is a side view of the inductor pump system having elevator air controls of FIG. 1A.
Figure 1C:
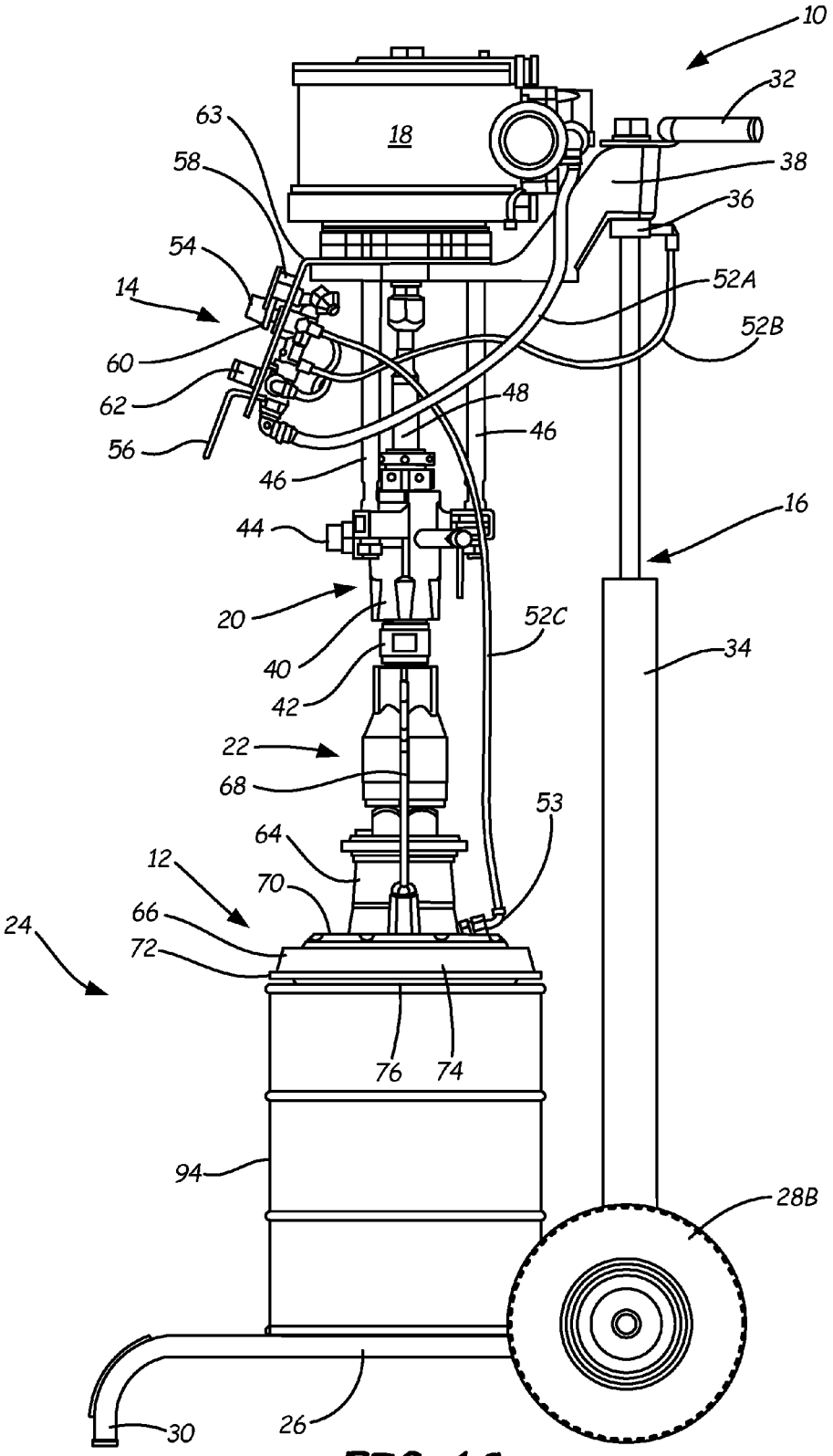
FIG. 1C is a side view of the inductor pump system having elevator air controls of FIG. 1A with a container located under the platen assembly.

FIG. 1A is a front view of inductor pump system 10 having elevator air controls 14 of the present invention. FIG. 1B is a side view of inductor pump system 10 having elevator air controls 14 of FIG. 1A. FIG. 1C is a side view of inductor pump system 10 having elevator air controls 14 of FIG. 1A with container 94 located under the platen assembly 12. FIGS. 1A, 1B, and 1C are discussed concurrently. Inductor pump system 10 also includes modular platen assembly 12, ram 16 (also called actuator) (FIG. 1B), air motor 18, pump 20 and ram pipe 22, all of which are carried by cart 24. Cart 24 comprises platform 26, wheels 28A and 28B, axle 29, kickstand 30 and handle 32. Ram 16 (FIG. 1B) includes cylinder 34, piston 36 and support bracket 38. Pump 20 includes housing 40, inlet 42, outlet 44 and mounting pins 46. Air motor 18 includes output shaft 48 (FIG. 1B). Elevator air controls 14 include inlet 50, outlet lines 52A and 52B (FIG. 1B), blow-off line 52C, check valve 53 (FIG. 1B), pressure regulator 54, on/off valve 56 (also known as first on/off valve), pressure gage 58, switching valve 60, relieving valve 62 (also known as second on/off valve) and mounting bracket 63. Modular platen assembly 12 includes hub 64, wiper ring assembly 66, bleed stick 68 and cover 70. Wiper ring assembly 66 includes wiper 72, spacer 74 and coupling ring 76.

Ram 16 comprises pneumatic cylinder 34 in which piston 36 is disposed. As shown in FIG. 1, piston 36 is fully seated within cylinder 34 of ram 16. Support bracket 38 is mounted to a top, exposed end of piston 36. Air motor 18 is mounted to the top of support bracket 38 and is controlled by elevator air controls 14, which are mounted to the front of support bracket 38. Pressurized air from a separate source (not shown) is provided to inlet 50 of elevator air controls 14. Air motor 18 receives a flow of pressurized air from elevator air controls 14 through line 52A. Cylinder 34 receives a flow of pressurized air from elevator air controls 14 through line 52B. Pump 20 is suspended from the bottom of support bracket 38 by pins 46 that connect to housing 40. Drive shaft 48 extends from air motor 18 to connect with pump 20. Ram pipe 22 connects to inlet 42 of pump 20 and a dispensing device (not shown) is connected to outlet 44 through a hose. Hub 64 of modular platen assembly 12 connects to ram pipe 22 and wiper ring assembly 66 connects to hub 64 using coupling ring 76.

Container 94 (FIG. 1C), which holds a fluid or viscous material that is to be dispensed by system 10 is stored on platform 26 so that container 94 is accessible to platen assembly 12. Wheels 28A and 28B are mounted on axle 29, which is connected to platform 26. Platform 26 is maintained level by wheels 28A and 28B and kickstand 30. However, by tipping cart 24 backwards on wheels 28A and 28B, such as by tilting ram 16 using handle 32, cart 24 can be easily moved to different locations. Once at the desired location, a dispensing device connected to pump 20 at outlet 44 is used to meter fluid pressurized by system 10. Specifically, modular platen assembly 12 is pushed by ram 16 to engage container 94 and push fluid into ram pipe 22 such that pump 20 can be operated by air motor 18 to dispense the fluid. Air controls 14 of the present invention are coupled to mounting plate 63 as discussed with reference to FIG. 2 and are arranged to control fluid flow through a number of fluid lines that form various fluid circuits, as discussed with reference to FIG. 3.

In operation, ram 16 is used to lift support bracket 38 up and away from platform 26 such that an empty container 94 can be removed from platform 26 and a full container 94 can be positioned between platform 26 and modular platen assembly 12. Specifically, with pressurized air delivered to inlet 50, on/off valve 56 is closed to prevent air from entering line 52A and air motor 18, while relieving valve 62 is opened to direct air to ram 16 by allowing air to enter line 52B, as is discussed in greater detail with reference to FIG. 4A. The pressurized air travels to the bottom of cylinder 34 through piston 36 and pushes piston 36 out of cylinder 34, pushing support bracket 36 away from platform 26. If needed, switching valve 60 is actuated to cut off air flow to line 52B and to deliver air to platen assembly 12 through line 52C to assist in movement of platen assembly 12, as discussed in greater detail with reference to FIG. 4B. Subsequently, container 94 storing a viscous fluid is positioned on platform 26 below wiper ring assembly 66. Relieving valve 62 is repositioned to stop providing pressurized air to cylinder 34, allowing modular platen assembly 12 to fall into container 94, as can be seen in FIG. 1C and discussed in greater detail with reference to FIG. 4C. Check valve 53 prevents flow of air from container 94 into switching valve 60 or cylinder 34. Additionally, bleed stick 68 can be manually actuated to allow airflow into and out of container 94 through a vent in hub 64. The speed of travel of piston 36 is controlled by the rate at which air is permitted to leave cylinder 34 at a relief orifice in relieving valve 62. Additionally, the descent of modular platen assembly 12 can be paused by actuating switching valve 60 while relieving valve 62 is closed to prevent air in cylinder 34 from reaching the relief orifice in relieving valve 62 and leaving cylinder 34, as discussed in greater detail with reference to FIG. 4D.

On/off valve 56 is positioned to permit pressurized air to flow to air motor 18, which causes air motor 18 to actuate drive shaft 48, as discussed in greater detail with reference to FIG. 4E. Depending on the type of pump used, drive shaft 48 rotates or reciprocates to drive pump 20. Pump 20 pressurizes the fluid provided by ram pipe 22 and distributes the pressurized fluid to outlet 44 whereby the dispensing device can be used to meter measured amounts of the fluid. As fluid from container 94 is consumed, modular platen assembly 12 falls to the bottom of container 94.

Wiper ring assembly 66 of modular platen assembly 12 engages the side of container 94 to push the viscous fluid downward, which forces the fluid up into a central bore located in hub 64 such that the fluid travels into ram pipe 22 and to pump 20. As modular platen assembly 12 descends into container 94, wiper 72 deflects to engage the sidewalls of container 94 to seal and scrape against container 94. Container 94 comprises many different configurations, such as the diameter of the sidewalls, the slope of the sidewalls, and the presence or not of ribbing, corrugations or other stiffening features in the sidewalls. Modular platen assembly 12 permits wiper ring assembly 66 and coupling ring 76 to be expediently removed from hub 64 without having to disassembly wiper 72 and spacer 74. As such, other wiper ring assemblies with different spacer and wiper configurations can be quickly secured to hub 64 for use with various configurations of container 94. Further description of modular platen assembly 12 is located in related U.S. Pat. No. 8,708,201 entitled "MODULAR PLATEN ASSEMBLY FOR INDUCTOR PUMP," which was filed on Jan. 12, 2011 and is incorporated herein by reference.

Figure 4A:
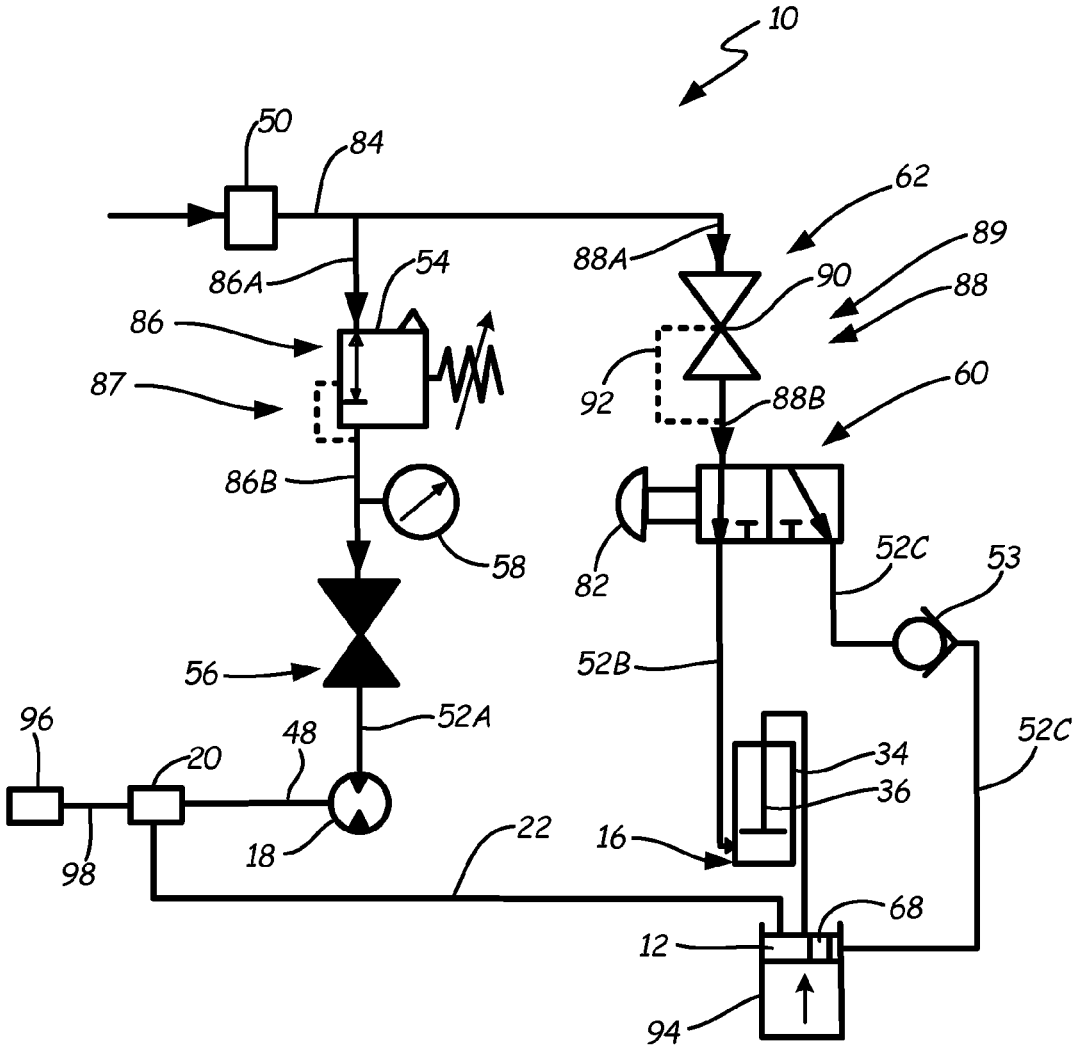
FIG. 4A is a flow diagram showing air flow through the air lines and valves of FIG. 3 while a platen assembly is lifted away from a container.
Figure 4B:
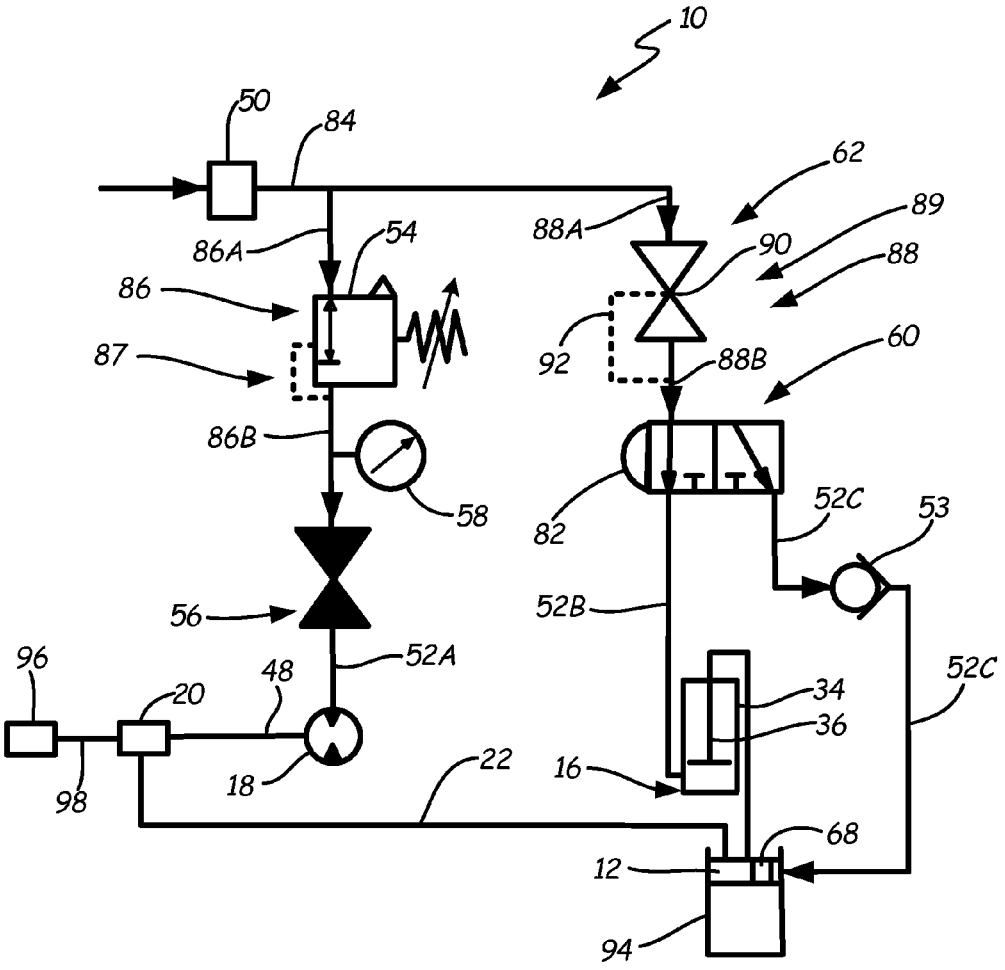
FIG. 4B is a flow diagram showing air flow through the air lines and valves of FIG. 3 while the container is being pressurized through the platen assembly.

To remove modular platen assembly 12 from container 94, the steps of FIGS. 4A and 4B are repeated. Specifically, relieving valve 62 is again positioned to allow pressurized air to flow into cylinder 34, and switching valve 60 is toggled to alternatively direct air from elevator air controls 14 to line 52C, which delivers pressurized air into container 94 through modular platen assembly 12 to prevent a vacuum from forming in container 94 and to help push wiper ring assembly 66 out of container 94. Air controls 14 allow pressurized air to be delivered to ram 16 and container 94 such that actuation of platen assembly 12 is more easily accomplished, while also allowing pressurized air to be delivered to air motor 18.

Figure 2:
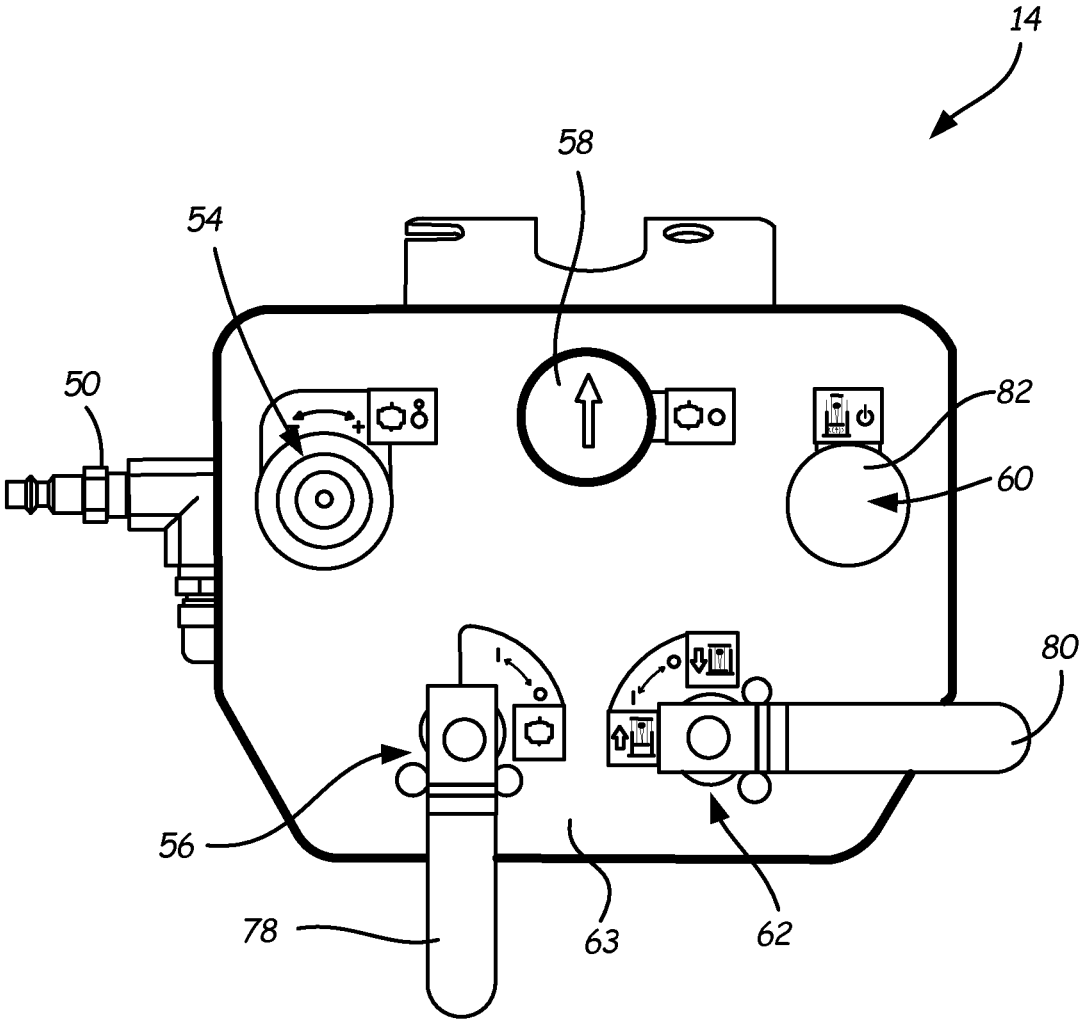
FIG. 2 is a front view of the elevator air controls of FIGS. 1A and 1B showing an on/off valve, a switching valve and a relieving valve positioned on a mounting bracket.

FIG. 2 is a front view of elevator air controls 14 of FIGS. 1A, 1B and 1C showing pressure regulator 54, on/off valve 56 (also known as first on/off valve 56), pressure gauge 58, switching valve 60 and relieving valve 62 (also known as second on/off valve 62) positioned on mounting bracket 63. Mounting bracket 63 comprises a metal plate mounted to support bracket 38 of ram 16 (FIGS. 1A, 1B and 1C) that is positioned for convenient use by an operator of system 10. Pressurized air is introduced to air controls 14 at inlet 50 and the various components of controls 14 control distribution of the pressurized air to the components of system 10. Mounting bracket 63 consolidates the location of controls for system 10 such that an operator need not move about system 10 to control its various components, such as air motor 18 and ram 16.

Operation of air motor 18 is controlled with on/off valve 56, pressure regulator 54 and pressure gauge 58. On/off valve 56 comprises a simple ball valve, as is known in the art, that opens and closes depending on the position of lever 78. With lever 78 oriented vertically as shown in FIG. 2, the ball closes the valve such that pressurized air cannot flow through valve 56. With lever 78 oriented horizontally, the ball opens the valve such that pressurized air flows through valve 56 to air motor 18. Pressure regulator 54 comprises any conventional regulator valve as is known in the art. Pressure regulator 54 matches the pressurized air provided to air motor 18 with the level of pressurized air demand by air motor 18. Pressure regulator 54 also prevents elevated pressures from reaching air motor 18. An operator of system 10 can manually adjust pressure regulator 54 to control the speed of air motor 18. Pressure gauge 58 comprises any pressure gauge as is known in the art and provides an indication of the pressure output of pressure regulator 54 to an operator of system 10. Operation of air motor 18 is controlled by pressure regulator 54 and on/off valve 56 independent of operation of ram 16.

Operation of ram 16 is controlled with switching valve 60 and relieving valve 62. Specifically, relieving valve 62 controls flow of pressurized air to ram 16 and switching valve 60 indirectly determines both upward and downward movements of ram 16 as used in system 10. Relieving valve 62 (also known as second on/off valve) comprises an on/off ball valve having a relief orifice, as is known in the art. Valve 62 opens and closes depending on the position of lever 80. With lever 80 oriented vertically, the ball closes the valve such that pressurized air cannot flow from inlet 50 through valve 62. However, with the ball closed, air is allowed to flow back into valve 62 from ram 16 (FIG. 1B) and out the relief orifice. With lever 80 oriented horizontally as shown in FIG. 2, the ball opens such that pressurized air flows through valve 62 to air switching valve 60.

In the embodiment described, switching valve 60 comprises a 3-way, 2-position pushbutton valve. Such valves and their functional equivalents are known in the art. Switching valve 60 includes an inlet into which pressurized air from valve 62 is introduced and two outlets for distributing the air to ram cylinder 34 and platen assembly 12 (FIG. 1B). Pushbutton 82 toggles switching valve 60 between delivering air to ram cylinder 34 and platen assembly 12. As such, various fluid lines are connected to the components of controls 14 to form a circuit for controlling air motor 18, and a circuit for controlling ram cylinder 34 and platen assembly 12, as is shown in FIG. 3.

Figure 3:
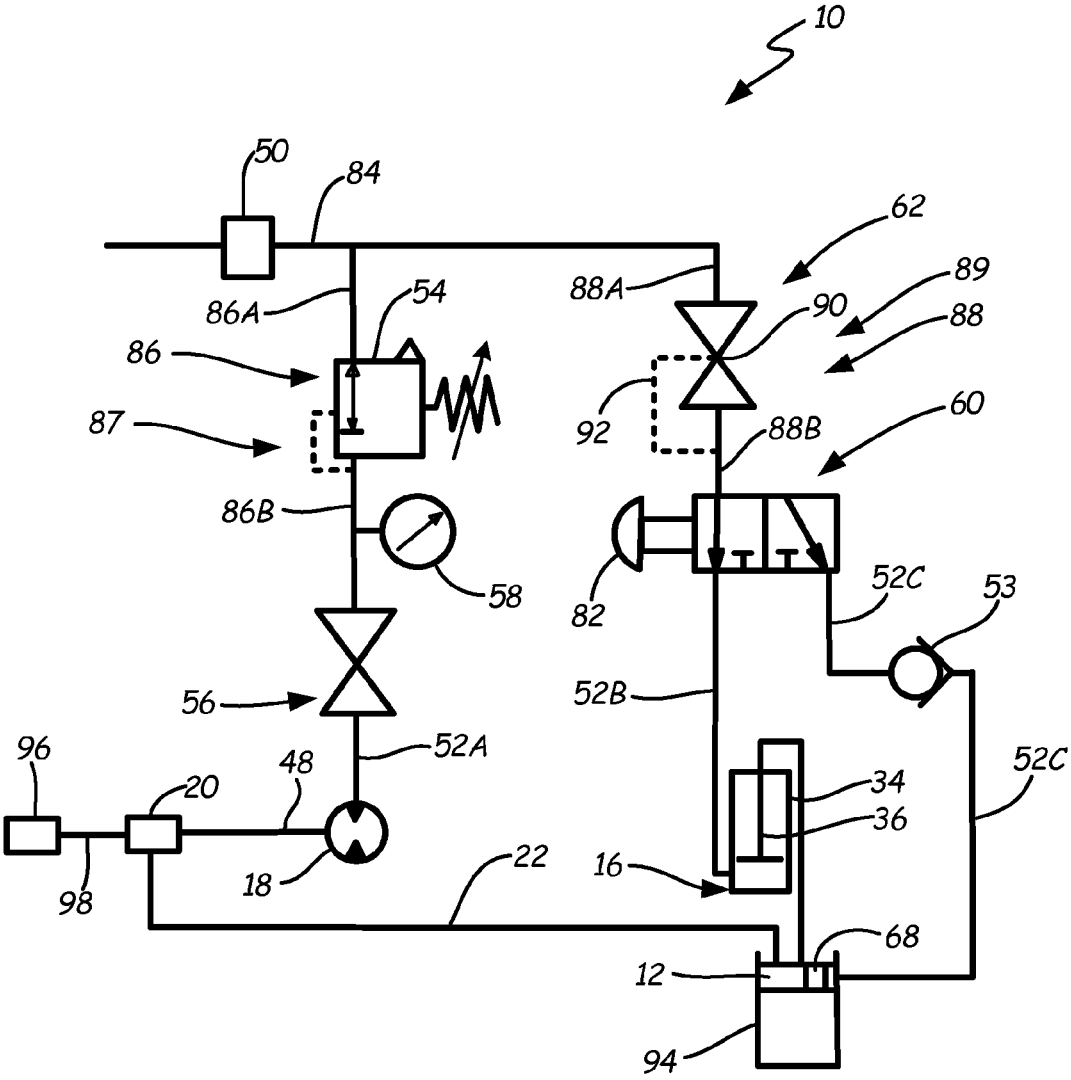
FIG. 3 is a schematic of air lines connecting the valves of the elevator air controls of FIG. 2 with components of the inductor pump system of FIGS. 1A and 1B.

FIG. 3 is a schematic of air lines 52A, 52B and 52C connecting on/off valve 54 (also known as first on/off valve 56), switching valve 60 and relieving valve 62 (also known as second on/off valve 62) (of elevator air controls 14 of FIG. 2) with air motor 18, pump 20, ram 16 and platen assembly 12 of inductor pump system 10 of FIGS. 1A and 1B. Pressurized air from inlet 50 is delivered to inlet line 84, which then splits the air between first circuit 86 and second circuit 88. First circuit 86 is formed of first fluid line 87, pressure regulator 54, pressure gauge 58, on/off valve 56, and air motor 18. Second circuit 88 is formed of second fluid line 89, relieving valve 62, switching valve 60, actuator line 52B, blow-off line 52C, check valve 53, ram 16, platen assembly 12 and bleed stick 68. First fluid line 87 includes inlet line 86, pressure line 86B, and outlet line 52A. Second fluid line 89 includes inlet line 88A and pressure line 88B. Relieving valve 62 includes relief orifice 90 and relief line 92. Air motor 18 includes output shaft 48 that drives pump 20. Pump 20 receives material from container 94 through ram pipe 22 and supplies pressurized material to dispensing device 96 through hose 98.

Inlet 50 is adapted to couple to a source of pressurized air. Inlet line 84 carries the pressurized air to first circuit 86 and second circuit 88. First circuit 86 and second circuit 88 operate independently of each other. In first circuit 86, pressure regulator 54, pressure gauge 58, on/off valve 56 and air motor 18 are connected in series. Thus, pressurized air flows to air motor 18 when on/off valve 56 is open, with the volume being controlled by regulator 54. Air motor 18 can be operated regardless of the state of second circuit 88 and without having to disconnect or reconnect any air inlet lines.

In second circuit 88, relieving valve 62 and switching valve 60 are connected in series. Inlet line 88A feeds relieving valve 62. Pressure line 88B feeds an inlet to switching valve 60 from an outlet of relieving valve 62. Relief orifice 90 is positioned within relieving valve 90 between the inlet and outlet. Relief line 92 connects the outlet of relieving valve 62 with relief orifice 90. Switching valve 60 includes two outlets, to which actuator line 52B and blow-off line 52C are connected. Actuator line 52B connects directly to cylinder 34 of ram 16. Pressurized air within cylinder 34 pushes piston 36 out of cylinder 34, carrying platen assembly 12 with it. Blow-off line 52C connects to platen assembly 12 and includes check valve 53, which permits flow into platen assembly 12 and prevents flow out of platen assembly 12. Air from blow-off line 52C pressurizes container 94, which is mounted on platform 26 (FIGS. 1A and 1B). Bleed stick 68 can be manually operated to relieve pressure within container 94. An exemplary bleed stick mechanism is described in U.S. Pat. No. 6,675,991 to Johnson et al., which is assigned to Graco Minnesota Inc. Platen assembly 12 pushes material from container 94 through ram pipe 22 to pump 20, where it provides pressurized material for metering with dispenser 96.

FIG. 4A is a flow diagram showing air flow through the air lines and valves of FIG. 3 while platen assembly 12 is being lifted away from container 94 by ram 16. FIG. 4A depicts a state of system 10 when an empty container 94 needs to be removed from platen assembly 12 such that a new, full container 94 can be positioned under platen assembly 12. On/off valve 56 is closed such that pressurized air from inlet 50 can travel through first circuit 86 only as far as regulator 54 and gauge 58. As such, air motor 18 is not operating. In second circuit 88, relieving valve 62 is open such that pressurized air from inlet 50 travels through relieving valve 62 and into switching valve 60. Button 82 of switching valve 60 is not pressed and switching valve 60 is not actuated such that pressurized air flows through switching valve 60 to actuator line 52B, but not to blow-off line 52C. Air from actuator line 52B enters cylinder 34, pushing piston 36 upwards. Platen assembly 12 is thus moved upwards within container 94. After platen assembly 12 traverses some distance within container 94, a vacuum begins to form within container 94 impeding further upward movement of platen assembly 12.

FIG. 4B is a flow diagram showing air flow through the air lines and valves of FIG. 3 while container 94 is being pressurized through platen assembly 12. FIG. 4B depicts a state of system 10 when it is desirable to eliminate a vacuum that has formed in container 94. On/off valve 56 remains closed such that air motor 18 is off, and relieving valve 62 remains open such that air flow to switching valve 60 remains active. Button 82 of switching valve 60 is pushed, or actuated, such that airflow from pressure line 88B is prevented from entering actuator line 52B, but is permitted to enter blow-off line 52C. The air passes through check valve 53 and platen assembly 12 and enters container 94, thereby pressurizing the backside of platen assembly 12 and neutralizing the vacuum therein. After the vacuum has dissipated, pushbutton 82 can be released to return system 10 to the state of FIG. 4A so lifting of platen assembly 12 with ram 16 can be resumed. Pushbutton 82 is subsequently toggled to lift platen assembly 12 and to fill the vacuum within container 94 until platen assembly 12 is removed from container 94. With platen assembly 12 elevated, the empty container 94 can be removed, a new container can be replaced and platen assembly 12 can be lowered into position. Platen assembly 12 can be held in place with piston 36 fully extended from cylinder 34 by leaving system 10 in the state of FIG. 4A.

Figure 4C:
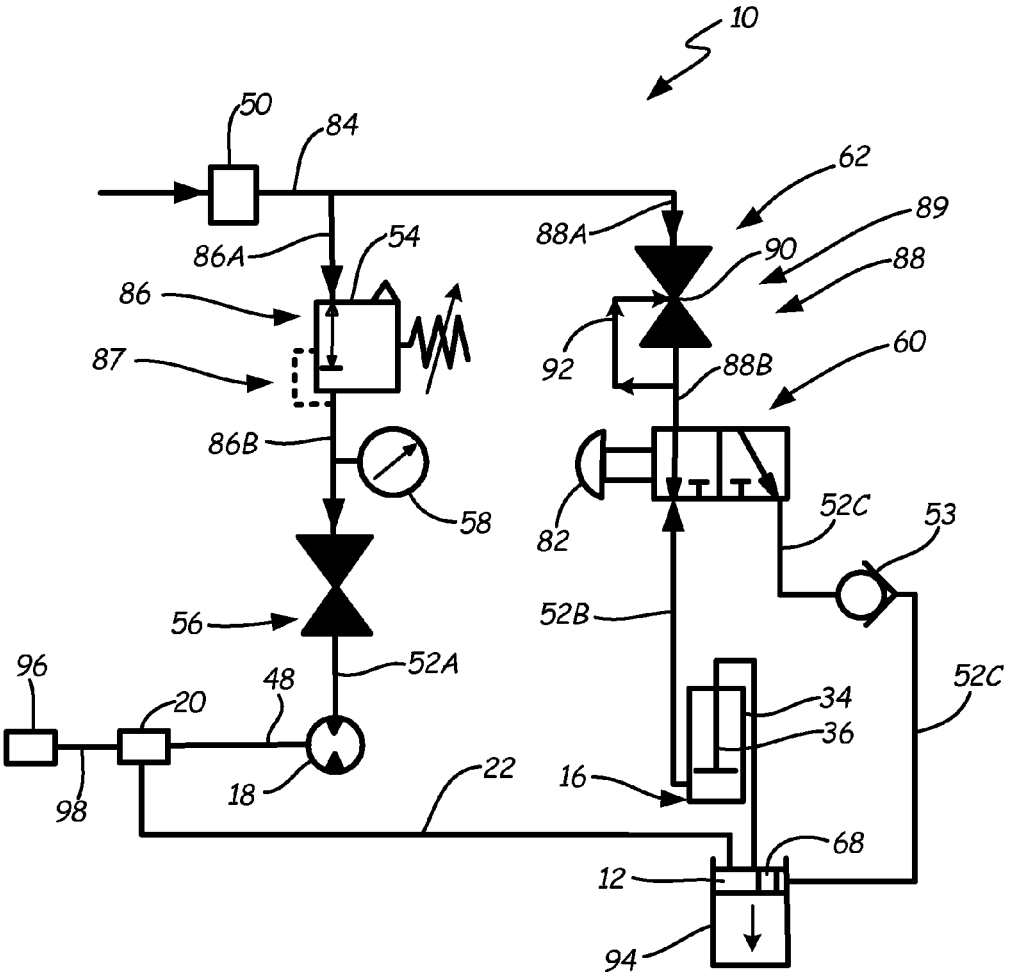
FIG. 4C is a flow diagram showing air flow through the air lines and valves of FIG. 3 while the platen assembly is descending into the container.

FIG. 4C is a flow diagram showing air flow through the air lines and valves of FIG. 3 while platen assembly 12 is descending into container 94. FIG. 4C depicts a state of system 10 when it is desirable to load a container full of material into system 10. On/off valve 56 of first circuit 86 again remains closed such that air motor 18 is off. Also, pushbutton 82 of switching valve 62 is released and relieving valve 62 is closed such that pressurized air does not flow to switching valve 62. With pushbutton 82 released, actuator line 52B is connected to pressure line 88B such that air from within cylinder 34 is allowed to pass into switching valve 60. With switching valve 60 closed, air from pressure line 88B can escape second circuit 88 through relief line 92 and relief orifice 90. Thus, piston 36 is unimpeded in its descent into container 94 and is free to push material in container 94 through ram pipe 22 to pump 20. Descent of piston 36 into container 94 can, however, be paused such that container 94 can be properly aligned with platen assembly 12.

Figure 4D:
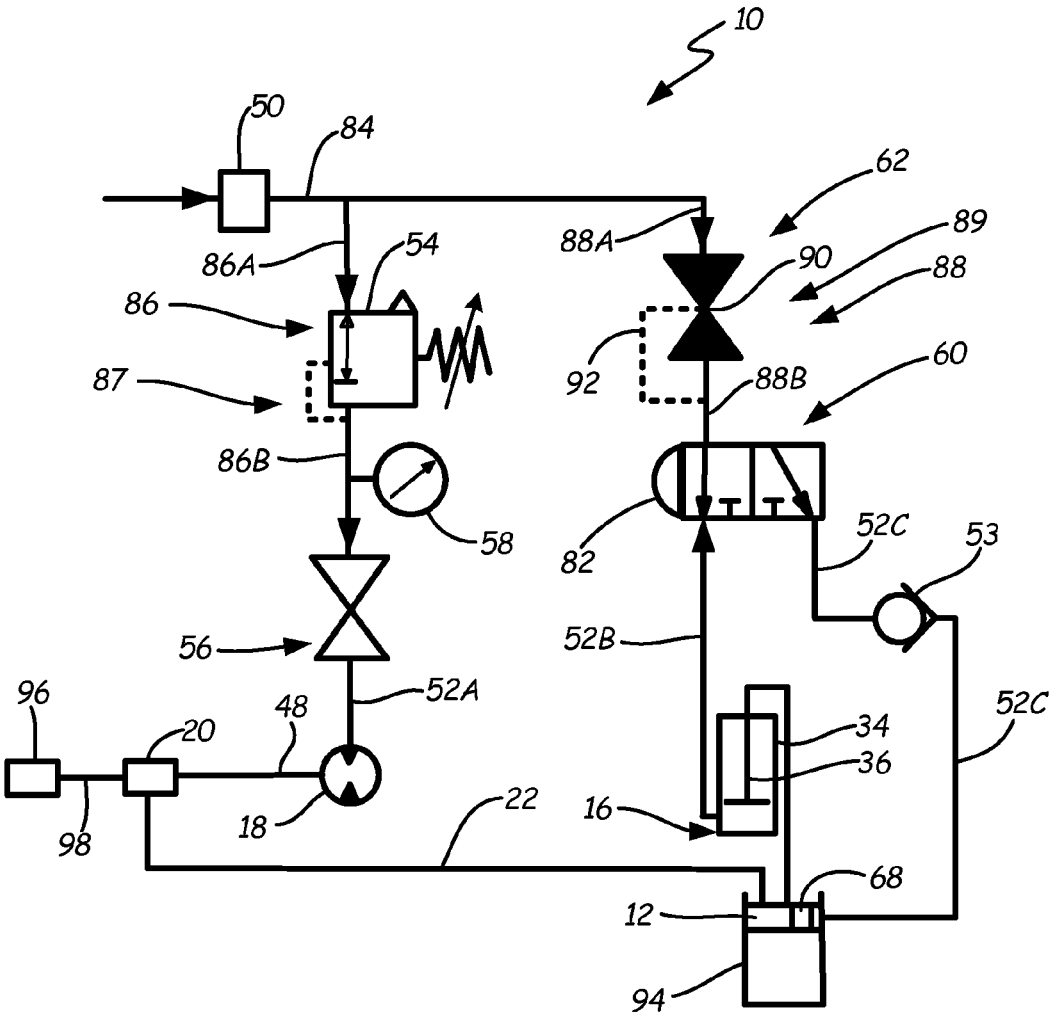
FIG. 4D is a flow diagram showing air flow through the air lines and valves of FIG. 3 while descent of the platen assembly into the container is paused.

FIG. 4D is a flow diagram showing air flow through the air lines and valves of FIG. 3 while descent of platen assembly 12 into container 94 is paused. FIG. 4D depicts a state of system 10 when it is desirable to align or realign container 94 with platen assembly 12 to prevent binding in the system. On/off valve 56 of first circuit 86 remains closed such that air motor 18 is off. Relieving valve 62 is also closed as in FIG. 4C such that pressurized fluid is prevented from flowing to switching valve 60. Pushbutton 82 of switching valve 60 is again pressed such that connection of actuator line 52B with pressure line 88B is cut off. Thus, air is prevented from escaping cylinder 34 through switching valve 60. The weight of piston 36 pressurized the air trapped within cylinder 34, resisting any further descent of piston 36. Thus piston 36 becomes locked in place. The position of container 94 can then be adjusted with platen assembly 12 at rest. With container 94 and platen assembly properly aligned, system 10 can be configured for distribution of material from container 94 using dispensing device 96.

Figure 4E:
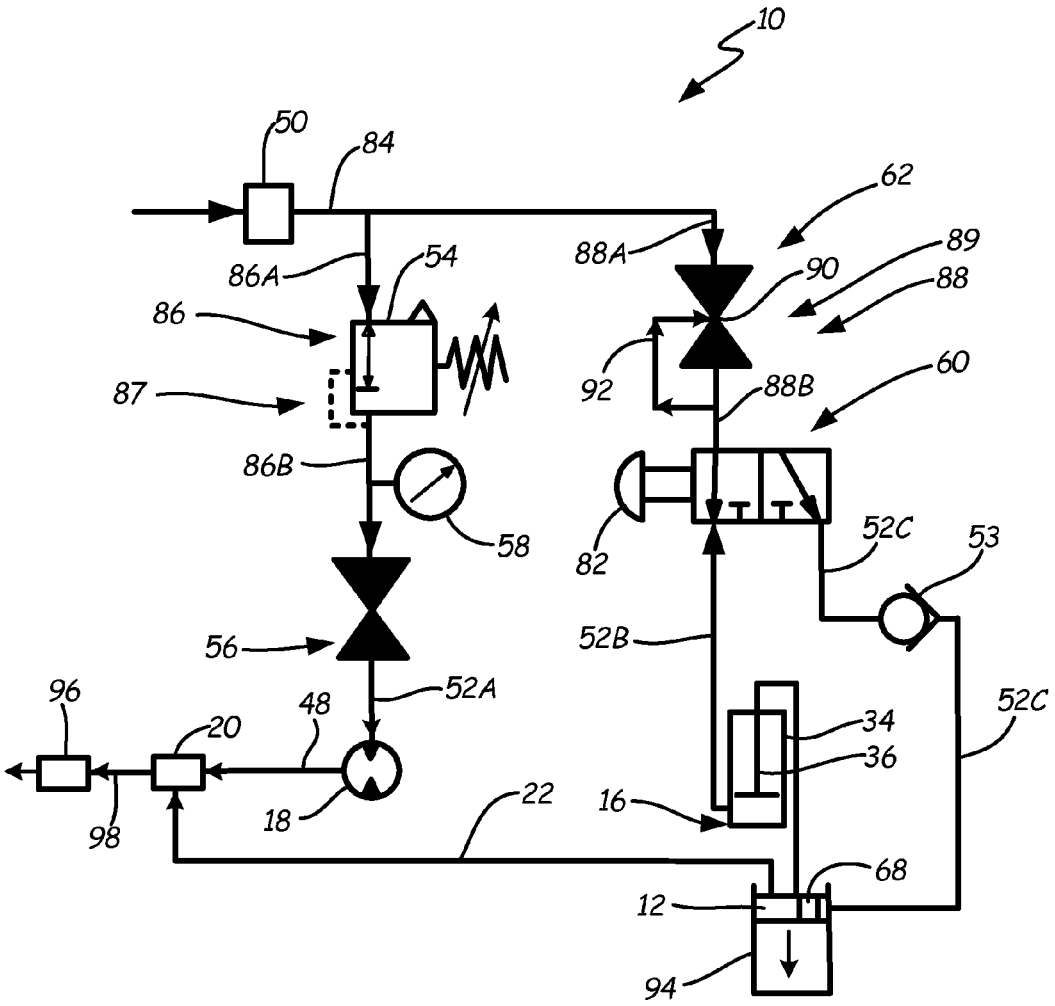
FIG. 4E is a flow diagram showing air flow through the air lines and valves of FIG. 3 while the platen assembly is descending into the container and the pump is activated.

FIG. 4E is a flow diagram showing air flow through the air lines and valves of FIG. 3 while platen assembly 12 is descending and pump 20 is activated. FIG. 4E depicts a state of system 10 when it is desirable to distribute material using dispensing device 96. Relieving valve 62 is closed as in FIG. 4D such that pressurized fluid is prevented from flowing to ram 16 or platen assembly 12 through switching valve 60. Pushbutton 82 is released such that air is allowed to escape cylinder 34 through relief orifice 90 as is FIG. 4C. Thus, platen assembly 12 is free to drop into container 94 to push material into ram pipe 22. Material in pipe 22 is delivered to inlet 42 (FIG. 1A) of pump 20. Pump 20 is actuated by air motor 18, which is activated by pressurized air from first circuit 86. Specifically, with on/off valve 56 open, pressurized air flows into air motor 18. Using pressure gauge 58 as an indicator, an operator can adjust pressure regulator 54 to allow a desired amount of air through pressure line 86B and valve 56 such that air motor 18 operates at a desired speed. Air motor 18 actuates shaft 58 to drive pump 20, which draws in material from pipe 22. Pump 20 pressurizes the material and distributes the material to hose 98. Dispensing device 96, which comprises any known device such as a spray gun or metering receives pressurized material from hose 98 and upon actuation by an operator, dispenses the material for a desired application or into a desired container.

Air controls 14 of the present invention permit an operator of inductor pump system 10 to operate both air motor 18 and ram 16 without having to reposition lines of pressurized air. For example, a pressurized air source does not need to be disconnected from cylinder 34 and reconnected to air motor 18. Thus, ram 16 and air motor 18 can be operated independent of the state of the other component. Furthermore, ram 16 can be fully operated to lift, pause and drop platen assembly 12. For example, pushbutton 82 of switching valve 60 allows for two-way flow of air from cylinder 34 so that platen assembly 12 can be lifted by actuating piston 36 or lowered by allowing piston 36 to fall into cylinder 34. Switching valve 60 and check valve 53 allow for one-way flow of air into platen assembly 12 such that air can be introduced into container 94 to assist in raising platen assembly 12 from container 12. Switching valve 60 can be actuated to lock air inside cylinder 34 pausing movement of piston 36. Thus, operation of inductor pump system 10 is expedited, reducing set up times and speeding up operations relating system 10.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method of operating an inductor pump system, the method comprising:
   - providing a source of pressurized fluid to a control module, the control module comprising a first fluid line connected to a first on/off valve and a motor, and a second fluid line connected to a relieving valve;
   - opening a relieving valve to allow pressurized fluid to flow through a switching valve to an actuator to raise a platen out of a container;
   - actuating the switching valve to direct fluid away from the actuator and to the container through the platen to pressurize the container; and
   - toggling the switching valve to alternately route air from the switching valve to the container or to the actuator.

2. The method of operating an inductor pump system of claim 1 and further comprising:
   - closing the relieving valve to stop flow of pressurized fluid to the switching valve; and
   - releasing the switching valve to permit air from the actuator to pass through the switching valve and escape through an orifice in the relieving valve such that the platen can descend.

3. The method of operating an inductor pump system of claim 2 and further comprising:
   - actuating the switching valve to cut off flow through the relieving valve and pause descent of the platen.

4. The method of operating an inductor pump system of claim 3 and further comprising:
   - releasing the switching valve; and
   - opening the first on/off valve to permit pressurized fluid to flow to a motor that drives a pump connected to the platen.

* * * * *